US010646031B2

(12) United States Patent
Schiffer

(10) Patent No.: US 10,646,031 B2
(45) Date of Patent: May 12, 2020

(54) FEEDING DEVICE FOR FEEDING BATCHES OF BRISTLE FILAMENTS TO A BRISTLE FILAMENT CASSETTE

(71) Applicant: M+C Schiffer GmbH, Neustadt/Wied (DE)

(72) Inventor: Küros Schiffer, Cologne (DE)

(73) Assignee: M+C SCHIFFER GMBH, Neustadt/Wied (DE)

( * ) Notice: Subject to any disclaimer, the term of this patent is extended or adjusted under 35 U.S.C. 154(b) by 153 days.

(21) Appl. No.: 15/570,028

(22) PCT Filed: Apr. 8, 2016

(86) PCT No.: PCT/EP2016/057784
§ 371 (c)(1),
(2) Date: Oct. 27, 2017

(87) PCT Pub. No.: WO2017/174152
PCT Pub. Date: Oct. 12, 2017

(65) Prior Publication Data

US 2018/0153299 A1 Jun. 7, 2018

(51) Int. Cl.

| | |
|---|---|
| ***A46D 3/08*** | (2006.01) |
| ***A46D 3/04*** | (2006.01) |
| ***A46D 99/00*** | (2006.01) |
| ***A46D 1/08*** | (2006.01) |

(52) U.S. Cl.
CPC ..... *A46D 3/082* (2013.01); *A46D 1/08* (2013.01); *A46D 3/04* (2013.01); *A46D 3/08* (2013.01); *A46D 99/00* (2013.01)

(58) Field of Classification Search
CPC . A46D 3/00; A46D 3/04; A46D 3/042; A46D 3/045; A46D 3/08; A46D 3/082; A46D 99/00
USPC ..... 300/1, 2, 4, 5, 7–9, 21
See application file for complete search history.

(56) References Cited

U.S. PATENT DOCUMENTS

| | | | | |
|---|---|---|---|---|
| 4,527,838 A | | 7/1985 | Boucherie | |
| 4,603,913 A | * | 8/1986 | Dorflinger ..... | A46D 3/082 300/7 |
| 4,610,481 A | * | 9/1986 | Steinebrunner ..... | A46D 3/082 300/21 |
| 4,647,113 A | * | 3/1987 | Steinebrunner ..... | A46D 3/082 300/21 |

(Continued)

FOREIGN PATENT DOCUMENTS

| | | |
|---|---|---|
| CN | 101468741 A | 7/2009 |
| DE | 19734615 A1 | 9/1998 |

(Continued)

*Primary Examiner* — Mark Spisich
(74) *Attorney, Agent, or Firm* — The Webb Law Firm

(57) ABSTRACT

A feeding device for feeding batches of bristle filaments to a bristle filament cassette includes a vertical magazine and at least one batch of bristle filaments arranged therein. In order to prevent individual bristle filaments from being pressed out of the batch of bristle filaments and to provide an ecologically optimized device, the batch of bristle filaments is held in a reusable and circumferentially enclosed batch carrier. A tufting device with the feeding device of a bristle filament cassette and a transfer device between the bristle filament cassette and the feeding device are provided. A corresponding method for fitting a brush is also provided.

17 Claims, 2 Drawing Sheets

(56) References Cited

U.S. PATENT DOCUMENTS

| | | | |
|---|---|---|---|
| 4,688,857 | A | 8/1987 | Boucherie |
| 5,823,633 | A | 10/1998 | Weihrauch |
| 6,582,028 | B2 | 6/2003 | Buchholz |
| 2003/0067207 | A1 | 4/2003 | Rueb |
| 2017/0119141 | A1 | 5/2017 | Kumpf |

FOREIGN PATENT DOCUMENTS

| | | | | |
|---|---|---|---|---|
| DE | 10062398 | A1 | | 7/2001 |
| DE | 10356316 | A1 | | 6/2005 |
| DE | 10 2013 003 249 | A1 | | 8/2014 |
| DE | 102013003249 | A1 | | 8/2014 |
| DE | 102014109320 | | * | 1/2015 |
| DE | 10 2015 109 706 | A1 | | 1/2016 |
| DE | 102015109706 | A1 | | 1/2016 |
| EP | 0088469 | A2 | | 9/1983 |
| EP | 0184866 | A1 | | 6/1986 |
| EP | 0759711 | B1 | | 9/1998 |
| EP | 1300097 | A1 | | 4/2003 |
| EP | 1181144 | B1 | | 1/2004 |
| EP | 1522234 | A2 | | 4/2005 |

* cited by examiner

FEEDING DEVICE FOR FEEDING BATCHES OF BRISTLE FILAMENTS TO A BRISTLE FILAMENT CASSETTE

CROSS-REFERENCE TO RELATED APPLICATION

This application is the United States national phase of International Application No. PCT/EP2016/057784 filed Apr. 8, 2016, the disclosure of which is hereby incorporated in its entirety by reference.

BACKGROUND OF THE INVENTION

Field of the Invention

The present invention relates to a feeding device for feeding batches of bristle filaments to a bristle filament cassette having the features of the preamble of claim 1.

Description of Related Art

A generic feeding device is known, for example, from EP 0 184 866 A1.

EP 0 184 866 A1 describes a tufting device for brushes with a vertical magazine in which pre-assembled batches of bristle filaments are held. Each batch of bristle filaments is enclosed by a paper sleeve and held together therewith as a pre-assembled bundle. These batches of bristle filaments thus pre-assembled, are stacked one above the other in the vertical direction between two walls of a vertical magazine that extend parallel to one another in the vertical direction so that the individual bristle filaments in the batches of bristle filaments held together by the paper sleeves, each have a bristle orientation in the horizontal direction.

The vertical magazine comprises an opening at the bottom from which the batches of bristle filaments, held together by the paper sleeve, can be dispensed individually.

The individual pre-assembled bristle batches drop into a receiving space, on the base of which a blade is arranged, where the blade cuts open the respective paper sleeve so that the bristle filaments are held in this receiving space likewise oriented in the horizontal direction.

A gripper grips the bristle filaments of the batch located in the receiving space, removes them from the receiving space, and transfers them into a bristle filament cassette.

The bristles, which are held by the gripper, are rotated together with the gripper by 90°, so that they are fed to the bristle filament cassette in a vertical orientation (in the vertical direction). There, the bristle filaments are pushed into an opening provided on the rear side of the bristle filament cassette.

Individual bristle bundles can then be removed or separated from this bristle filament cassette and attached to a brush base body.

A device for separating individual bristle bundles from such a bristle filament cassette is known, for example, from DE 197 34 615 A1.

The device known from EP 184 866 A1 produces a considerable amount of wastage and is mechanically complex.

Moreover, it has been found that, when processing the bristles while they are disposed vertically in the bristle filament cassette, in particular when bristle filaments are used that are sharpened or rounded at the ends, they easily migrate in the vertical direction out of the group of bristle filaments.

An alternative device for feeding bristles to a bristle filament cassette is known from EP 088 469 A2. Once large amounts of bristle filaments have been introduced perpendicularly into a horizontal magazine, smaller amounts are removed therefrom by way of complex kinematics and are fed to a bristle filament cassette in which the bristle filaments are also arranged perpendicularly, meaning in the vertical direction.

It has been found in this method as well that, especially when sharpened or rounded filaments are used, the bristles easily migrate in the vertical direction out of the group of bristle filaments.

SUMMARY OF THE INVENTION

In the light of the above-described prior art, the object of the present invention is to provide a feeding device for feeding batches of bristle filaments to a bristle filament cassette which can be operated in an efficient manner and is not susceptible to failure.

The above-described problem is solved according to a first aspect of the invention with a feeding device for feeding batches of bristle filaments to a bristle filament cassette, the feeding device comprising a vertical magazine and at least one batch of bristle filaments arranged therein. The batch of bristle filaments is held in a reusable and circumferentially enclosed batch carrier.

It is characterized, in particular, in that batches of bristle filaments, e.g. a larger group of bristle filaments, are held in a reusable, circumferentially enclosed batch carrier.

To the extent that a reusable batch carrier is in fact used instead of a simple paper or plastic sleeve, which during the transfer first needs to be cut open at its circumference when the individual pre-assembled batches of bristle filaments are fed from the vertical magazine to a bristle filament cassette in order to remove the pre-assembled batches of bristle filaments from this paper or plastic sleeve, the configuration according to the invention can avoid wastage, which could possibly also get caught in parts of the device.

In particular, it has been shown in the course of the method that, when such reusable batch carriers are used, the removal of the batches of bristle filaments from the batch carrier can also be simplified since the respective batch of bristle filaments can easily be discharged from the batch carrier in the axial direction of the filaments when the latter is securely held.

Where simple paper sleeves are used, as described in EP 0 184 866 A1, it is not possible to securely hold them and reliably remove all bristle filaments from this sleeve and separate them therefrom.

A magazine in which the batches of bristle filaments accommodated in the batch carrier are held vertically one above the other, where the individual bristle filaments of each batch have a horizontal orientation, can be seen as being a vertical magazine. The previously described vertical magazine known from EP 0 184 866 A1 is with this reference made to be part of the disclosure content of the present application and represents an example of a vertical magazine.

A bristle filament cassette is understood by the present invention to preferably mean to be that container the intermediate storage of bristle filaments from which bristle filaments, which form a predetermined number of individual bristle bundles, are subsequently indirectly or directly attached in or on a brush body.

According to an advantageous development of the invention, the batch carrier can be formed by a frame which is open on both sides in the horizontal direction and is designed in such a way that substantially the entire batch of bristle filaments can be introduced into this frame from one side and can be removed from this frame on the opposite side.

According thereto, such a frame preferably comprises an opening on each of the sides disposed opposite to each other and an inner circumferential surface extending from there in a stepless manner, so that the batch of bristle filaments is pressed out from this frame once pressure is applied from the side of the one opening to the respective bristle ends of the batch, i.e. to the batch boundary surface of the batch, without substantial amounts of bristle filaments remaining in the batch carrier.

The frame can there be held, for example, in a support device and, for example, the entire batch of bristle filaments can be pressed out of this frame by way of pressurized air applied to the opening previously mentioned, and can subsequently be fed, for example, directly or indirectly to the bristle filament cassette.

The horizontal direction and the vertical direction are understood to mean the respective direction which is aligned horizontally relative to the assembly surface of the device, i.e. the ground, or vertically thereto, respectively.

As a result of the above-described embodiment, in particular, a simpler transfer from the batch carrier to the bristle filament cassette can be achieved without substantial amounts of the bristle filaments being retained in the batch carrier.

According to a preferred embodiment of the invention, the frame can be formed by a ring. Such a ring has substantially a round or very slightly oval design.

In such a ring-like configuration, the individual bristle filaments in the batches of bristle filaments are held uniformly within the batch carrier and cannot become caught in corners during a later transfer.

In addition, the ring-like configuration of the batch carriers ensures that they are not as easily damaged by forces bearing upon them during storage, transport and/or return, after the batches of bristle filaments have been ejected, than if they were angular in shape.

According to a preferred development of the invention, the frame can have a thickness that substantially corresponds to a length of the filaments contained in the batch of bristle filaments.

In this embodiment, the frame can be substantially formed only by a wall, the extent of which in the vertical direction corresponds to the length of the bristle filaments of the filaments contained in the batch of bristle filaments, that is to say substantially to the thickness (in the vertical orientation) of the batch of bristle filaments.

Therefore, the respective ends of the bristle filaments are provided substantially immediately at the level of the openings defining the frame in the vertical direction.

The end surfaces of the batch, which are formed by the corresponding ends of the pre-assembled bristle bundles of the batch, therefore abut flush with the edges defining the batch carrier in the thickness direction.

This provides the most compact configuration. Removal of the bristles from the batch carrier is also facilitated.

According to a preferred development of the invention, the frame can have a substantially uniform wall thickness in its circumferential direction.

If the wall thickness in the circumferential direction is substantially the same, a simple procedure for producing the respective batch carrier can be realized. However, such a uniform wall thickness in the circumferential direction does not rule out that the wall thickness of the frame or within the frame, differs in the thickness direction.

Preferably, however, this wall thickness should also be the same in the thickness direction, with the exception of holding flanges on the frame.

According to a further preferred development of the invention, the frame can be an injection-molded member.

In particular, such an injection-molded member is to be understood as being a plastic injection-molded member made of thermoplastic material. This injection-molded member can therefore be easily produced and thereby provides a uniform batch carrier. The entire batch carrier is therefore preferably designed as a homogenous injection-molded member and has a configuration such that the latter has a certain degree of dimensional stability when the batch of bristle filaments is removed from this batch carrier so that it does not substantially change its shape.

For example, it is possible that the batches of bristle filaments can simply again be inserted into this batch carrier during the next use of the batch carrier.

According to a preferred development of the invention, the frame can comprise an orientation identification device by way of which the frame can be oriented in the vertical magazine in such a way that the filaments of the batch of bristle filaments arranged therein are always positioned in the vertical magazine having a predetermined orientation with respect to the bristle filament cassette.

It can be prevented with such an alignment identification device that the bristle filaments pre-assembled in batches are introduced into the vertical magazine with an orientation that differs from that in which they are needed for tufting. It is therefore possible to recognize, with this alignment identification device, which end of the filaments, for example, the application side end or the fastening side end, forms the respective end surface on both sides or the horizontal openings of the frame, respectively.

An outcome regarding the position of the ends of the individual filaments in the batch of bristle filaments can therefore be drawn by way of a device on the frame. This is particularly advantageous when the two ends of the filaments are formed differently, e.g. the application side end is pointed or rounded and the fastening side end is formed to be substantially planar.

According to a preferred further development of the invention, the orientation identification device can be formed by a flange surrounding at least one of the two horizontal openings of the frame on the outside.

Such a flange is, in particular, a type of thickening which is attached, for example, integrally thereto during the injection-molding process of the frame.

This flange can serve as a kind of guiding element which guides the batch carrier along the walls of the vertical magazine and/or also guides it from the vertical magazine to the bristle filament cassette during the feed. This guidance can be ensured, in particular, by the interaction of the flange with a groove on the walls of the vertical magazine. This flange is therefore provided to ensure a predetermined position of the frame always with the respectively determined bristle orientation.

Furthermore, the flange can additionally or alternatively also serve as a holding device where a gripper engages in order to take the batch carrier from one position to the other. The flange and the ring are preferably formed to be rotationally symmetrical.

According to an independent aspect of the invention, the present invention provides a tufting device for brushes comprising: a feeding device for feeding batches of bristle filaments to a bristle filament cassette, the feeding device comprising a vertical magazine and at least one batch of bristle filaments arrange therein, wherein the batch of bristle filaments is held in a reusable and circumferentially enclosed batch carrier; a bristle filament cassette to which the batch of bristle filaments pre-assembled in the tufting device can be fed with a transfer device; a bristle bundle separating device, by use of which at least one bristle bundle can be separated from the bristle filaments contained in the bristle filament cassette. The tufting device is configured to insert the bristle bundle, which is separated by the bristle bundle separating device, into a brush head. The transfer device is configured to feed the batch of bristle filaments to the bristle filament cassette while maintaining a horizontal bristle filament axis orientation of the batch.

According to an independent aspect of the invention, the present invention provides a tufting device having the features of claim 10.

This tufting device can comprise at least the aforementioned feeding device, a bristle filament cassette and a transfer device provided between the bristle filament cassette and the feeding device.

The transfer device is generally designed in such a way that the batches of bristle filaments are fed to the bristle filament cassette while maintaining the horizontal bristle filament axis orientation. In particular, it is thereby possible to prevent individual bristle filaments from being pressed out of their group during the transfer to the bristle filament cassette.

The bristles are therefore held in the horizontal direction in the bristle filament cassette.

Respective bristle bundles are subsequently gripped or separated from this bristle filament cassette, as described, for example, in DE 100 623 98 A1 or in EP 1 522 234 A2, by use of a bristle bundle separating device, and are, in a further step, attached in the brush head. The bristle bundle separating device described in DE 100 623 98 A1 or in EP 1 522 234 A2 is with this reference made to be part of the disclosure content of the present application and constitutes an example of a bristle bundle separating device.

The bristle filament cassette should therefore preferably be seen as being a receiving space for bristle filaments from which bristle bundles are removed directly in the respectively required quantity, as they are also later used on the brush head as a bundle, and are then directly or indirectly conveyed to the brush head to be attached thereto.

In the simplest case, such a transfer device can be a type of chute on which the batch carriers are guided with the batches of bristle filaments pre-assembled therein from the vertical magazine to a filling opening of the bristle filament cassettes before the respective bristle filament batch is then removed from the batch carrier, in particular immediately upstream of the filling opening, and fed to the bristle filament cassette, e.g. by way of a pusher.

Alternatively, however, a transfer device designed as a gripping device is also conceivable, with which the individual batch carriers are gripped and transferred. The previously described gripper known from EP 0 184 866 A1 is with this reference made to be part of the disclosure content of the present application and constitutes an example of a transfer device.

Any transfer device, which transfers a batch of bristle filaments with or without a batch carrier from the vertical magazine to the bristle filament cassette in one or more steps, can be seen as being such a transfer device, but preferably the batches of bristle filaments are transferred with the batch carrier to the filling opening of the bristle filament cassette.

According to an advantageous development of the invention, an ejector can be associated with the transfer device and eject the batch of bristle filaments out of the batch carrier by use of compressed air and feed it to the bristle filament cassette.

It is in particular advantageous to provide as few mechanical elements as possible, since they are prone to damage.

Accordingly, it has proven to be particularly favorable to have the batch carrier, with the batch of bristle filaments contained therein, taken from the vertical magazine into the vicinity of the bristle filament cassette and there be pressed out of the batch carrier by use of compressed air.

According to an advantageous development of the invention, a batch carrier return device can be associated with the transfer device and transfer the emptied batch carrier to a collecting point.

After the reusable batch carrier is thus emptied, it should preferably be collected again and the batch carriers thus collected are to be returned to a station where they are loaded with respective batches of bristle filaments.

The batch carrier return device can be formed by the transfer device itself or else by a separate device, such as a separate gripper or a separate channel structure, through which the emptied batch carriers are taken to a collecting point.

According to an advantageous development of the invention, the separated bristle bundle can be fed to the brush head while maintaining the bristle filament orientation.

In this preferred embodiment, the horizontal orientation of the filaments of the individual batches of bristle filaments is maintained from the introduction of individual batches of bristle filaments into the vertical magazine up to the attachment of the bristle bundles in or on the brush head.

As a result, it is possible during the procedure to prevent the filaments from being pressed out of the group or protrude therefrom due to adhesion forces between the individual filaments, in particular when the filaments are sharpened or rounded at the their end.

According to a further independent aspect of the invention, it proposes a method for fitting a brush, in particular a toothbrush with bristle bundles, comprising the steps of: supplying batches of bristle filaments, that are pre-assembled and held in a circumferentially enclosed batch carrier, to a vertical magazine in which the bristle filaments are oriented horizontally in the batch of bristle filaments and transferring the batch of bristle filaments by the way of a transfer device to a bristle filament cassette. The batch of bristle filaments is held in a reusable batch carrier.

In particular the previously described feeding device according to the invention as well as the above-described tufting device can be used in this method.

This method is preferably used for fitting respective bristle bundles onto a toothbrush.

In this method, the bristle filaments held in the batch carrier are aligned horizontally in the batches of bristle elements in the vertical magazine, and the previously described reusable batch carrier, is used.

A more ecological waste-avoiding procedure is provided due to the horizontal orientation of the bristle filaments in the individual batches in the vertical magazine in combination with the reusable batch carrier, where the bristle filaments are not easily pressed out of the group in the individual batches of bristle filaments.

According to a preferred procedure, the batch of bristle filaments can maintain its bristle filament axis orientation during the transfer. This feature can also by itself form an embodiment of the method according to the invention, instead of the reusable batch carrier that holds the batch of bristle filaments.

As described above, because the batches of bristle filaments maintain their bristle filament orientation, at least during the transfer from the vertical magazine into the bristle filament cassette, it is possible to prevent individual bristle filaments from being pressed out of the group in the end side direction thereof from the respective group of bristle filaments.

According to a preferred development of the invention, bristle bundles from the bristle filament cassette can be separated and fed to a brush head to which they are attached, where the bristle bundles maintain their bristle filament axis orientation during the removal from the bristle filament cassette and the feed to the brush head.

Where the method is performed according to this preferred embodiment, the horizontal orientation of the bristle filaments is maintained from the step, in which the batches of bristle filaments are fed to the vertical magazine, until the individual bristle bundles are arranged on or attached to the brush head, i.e. these filaments are moved in horizontal orientation during the entire time.

According to a preferred development of the invention, the bristle filament axis orientation can be maintained from where the batches of bristle filaments held in the batch carrier are fed to the vertical magazine up to the feed to the brush head.

According to a preferred development of the invention, the batches of bristle filaments held in the batch carrier can be ejected from the batch carrier by use of compressed air and be fed to the bristle filament cassette.

For example, a stream of compressed air can act upon an open side of the batch carrier, and substantially the entire batch of bristle filaments can be transferred as one entity out of the batch carrier on the other side.

According to a further preferred development of the invention, the emptied batch carrier can be transferred to a collecting point. In particular, the tufting device may be provided with a batch carrier return device that is associated with the transfer device and transfers the emptied batch carrier to a collecting point.

In addition to the aspects of the invention described, the reusable batch carrier for feeding batches of bristle filaments to a bristle filament cassette comprises at least one batch of bristle filaments arranged therein. The batch of bristle filaments is held in a reusable and circumferentially enclosed batch carrier. The present invention also provides a batch of bristle filaments bundled in a circumferentially enclosed batch carrier, where the batch carrier is a reusable batch carrier.

This can save a significant amount of wastage.

In particular, the use of such a reusable batch carrier in a method for producing brushes, in particular toothbrushes, can also by itself form an invention.

BRIEF DESCRIPTION OF THE DRAWINGS

Further advantageous developments of the invention are described below with reference to an embodiment in conjunction with the drawing, in which.

DESCRIPTION OF THE INVENTION

Figure 1:
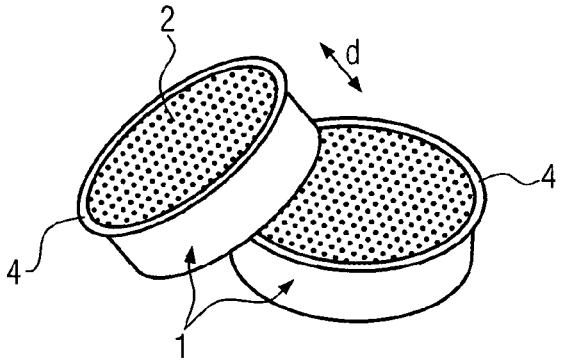
FIG. 1 shows examples of batches of bristle filaments which are held in a reusable and circumferentially enclosed batch carrier.

FIG. 1 shows two batch carriers 1, each of which contains a batch of pre-assembled bristle filaments, i.e. a batch 2 of bristle filaments.

As shown for batch carrier 1 in FIG. 1, its thickness d substantially corresponds to the length of a longitudinal extension of the bristle filaments combined in batch 2 of bristle filaments, or the thickness or height h of batch 2 of bristle filaments, respectively.

The individual batches 2 of bristle filaments held in batch carrier 1 are sorted in the vertical direction one above the other in a vertical magazine 200 (cf. FIG. 3), as shall be described later with reference to FIG. 3, so that the orientation of the bristle filaments in batch 2 of bristle filaments is the horizontal direction.

In FIG. 1, however, the right lower batch carrier 1 is located in such a manner that the bristle filaments, which can not be seen in detail, are oriented in the vertical direction in the batch of bristle filaments.

In the embodiment, batch carrier 1 comprises a frame that is open on both sides, openings 3, 3' of which defining the latter on both sides.

Openings 3, 3' of the frame are provided oppositely disposed in the batch carrier in a direction which is designated as being the thickness direction. This thickness direction is also referred to as the horizontal direction, since batch carrier 1 is held upright in vertical magazine 200.

In the example shown in FIG. 1, batch carrier 1 comprises a circumferential flange 4 at opening 3' which projects from the outer wall, by way of which the batch carrier is guided in vertical magazine 200, for example, along vertical walls 201 to be described later.

The batch carrier can have a diameter D of between 20 and 60 mm. Further preferred diameters are 30, 40, 50 mm. The aforementioned values can each form upper and lower limits of a diameter range.

The thickness of the batch carrier can be between 10 and 30 mm. In particular, the following thicknesses are advantageously 15, 25 mm. These values as well can by themselves also form upper and lower limits of the thickness range.

All filaments of a batch of bristle filaments preferably have the same length. Batch 1 of bristle filaments comprises two planar end faces in which the respective ends of the bristle filaments are located.

Figure 2:
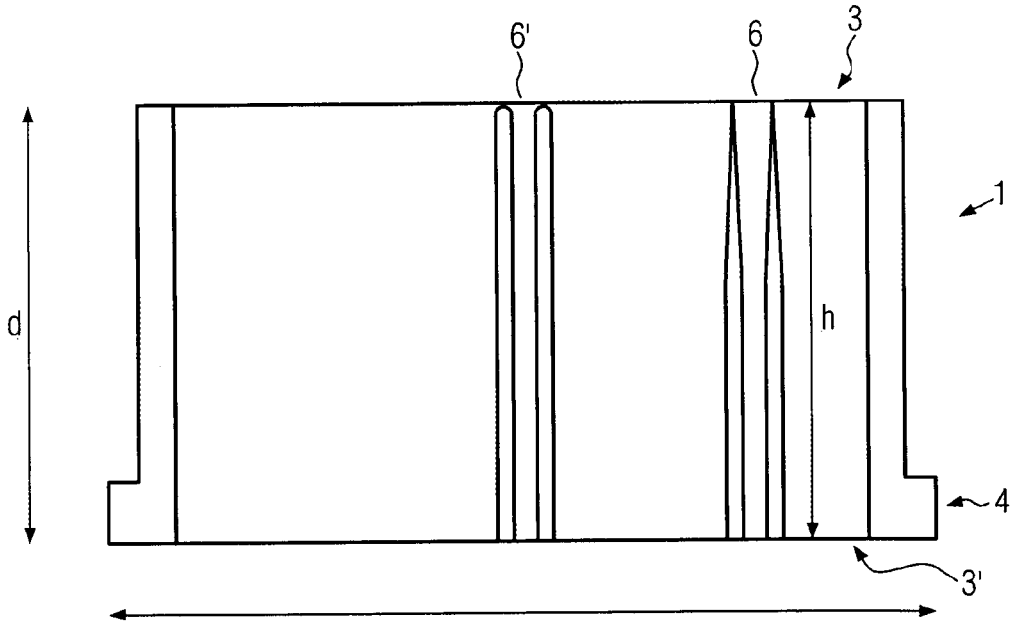
FIG. 2 shows a cross-sectional view of the batch carrier according to the invention with two different examples of bristle filament types held therein.

As shown in FIG. 2, the individual bristle filaments 6, 6' can be sharpened on one side or rounded off on one side and, in particular, be provided within batch carrier 1 subject to compression pressure. Preferably, the diameter of the filaments is between 0.05 and 0.3 mm, preferably 0.1, 0.15, 0.2, 0.25 mm. These values as well can by themselves also form upper and lower limits.

As can be seen from FIG. 1 in conjunction with FIG. 2, the batch carrier has, in particular, a wall thickness that is uniform in the circumferential direction. Preferably, as in the present example, the batch carrier can be designed in the manner of a frame, in particular a ring, and can be made of plastic material by way of injection molding.

In contrast to the non-reusable paper sleeve, batch carrier 1 has a certain structural rigidity.

Figure 3:
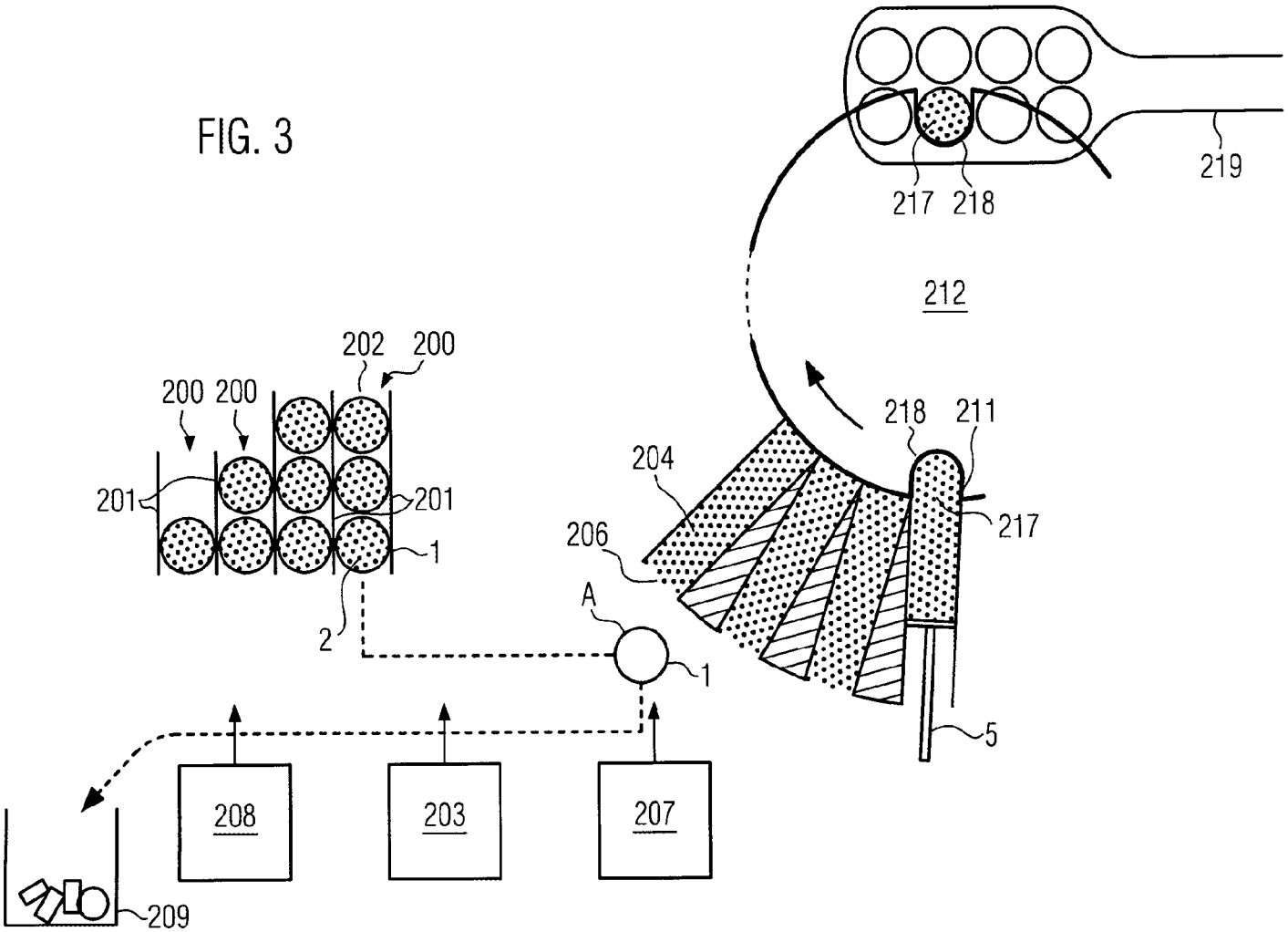
FIG. 3 shows a schematic view of a tufting device.

Such a batch carrier 1 is shown, for example, in FIG. 3 introduced from above into a guide between two vertical walls 201 of vertical magazine 200.

In the embodiment of FIG. 3, five vertical walls 201 extending parallel to one another and oriented in the vertical direction form four vertical magazines 200, or a plurality of vertical magazines. Batches 2 of bristle filaments pre-assembled in batch carriers 1 are each introduced into each vertical magazine 200 one behind the other in the vertical direction. Vertical magazines 200 each have a threading opening on the upper side so that batch carriers 1 can be inserted between respective vertical walls 201. The threading openings are located, for example, directly adjacent to trays, not shown in the figure. A plurality of batch carriers with the batches of bristle filaments contained therein is delivered on such trays. The batch carriers are then inserted individually, for example, into the vertical magazine.

However, a single vertical magazine and a single batch carrier are already sufficient for such feeding.

Instead of such vertical walls, any other configuration can also be provided, so that the respective batch carriers are each held in an upright position in the vertical magazine such that the bristle filaments in batch 2 of bristle filaments are oriented horizontally.

In the present example, different types of pre-assembled batches of bristle filaments with bristles that are sharpened, non-sharpened, of different length, of different thickness, of different color can be provided in adjacently disposed vertical magazines 200 each with a separate feed opening 202.

A transfer device 203, shown schematically in FIG. 3 as a box, can transfer individual batch carriers 1 with batches 2 of bristle filaments contained therein from vertical magazine 2 to the vicinity of an associated bristle filament cassette 204 or its filling opening 206, respectively.

For this purpose, for example, batch carriers 1 are individually released one after the other at the respective outlet opening of each vertical magazine 200 and are removed from vertical magazine 200 at the bottom, as shown in the embodiment of FIG. 3, and are taken to the vicinity of bristle filament cassette 204, while maintaining an orientation in which the bristle filaments are oriented in the horizontal position.

Transfer device 203 can be formed by a movable gripper, which grips each batch carrier individually, and/or by way of a type of chute in which the walls are arranged in such a way that the individual batch carriers are transferred on a predetermined path due to the gravitational force, and/or by way of a line system, for example, in the manner of a pipe mail, in which the batch carriers are transferred, in particular, by use of vacuum/compressed air.

At the position, which in FIG. 3 is designed by A and located in the immediate vicinity of filling opening 3 of the left one of the four bristle filament cassettes 204 in FIG. 3, the batch of bristle filaments received in batch carrier 1 is then ejected by way of an ejector 207, so that the batch of bristle filaments is ejected through the opening of the batch carrier, and the batch carrier thus emptied is returned to a collection container 209 by way of a batch carrier return device 208 which in FIG. 3 is likewise schematically illustrated as a box.

The ejector 207 preferably operates according to the principle of compressed air so that one side of the batch carrier or the batch of bristle filaments is acted upon by compressed air, and the batch of bristle filaments is ejected on the other side of batch carrier 1 into a receiving space which is associated with filling opening 206 of bristle filament cassette 204.

From there, for example, the bristles can be pressed with a pusher S between the respective defining walls of and into bristle filament cassette 204, being formed in the shape of an elongated box, while maintaining their horizontal orientation, as shown schematically in FIG. 3 for the right one of the four bristle filament cassettes 204.

Preferably, an empty bristle filament cassette 204 is filled with the respective batches of bristle filaments substantially at the same time, from which no bristle bundle 217 is removed. When bristle filament cassette 204 is filled from the back, a bristle bundle removal opening 211 is preferably closed at the front side by a further pusher (not shown in FIG. 3).

In the meantime, for example, bristle bundles 217 are removed from another of the four bristle filament cassettes 204, the cassette shown at the left in FIG. 3, by use of a bristle bundle separating device 212 which has an arc-shaped configuration.

Batch return device 208 [sic] can also be any device with which empty batch carriers 1 are transferred to position A into collection container 209 after having been emptied. It can be formed by a movable gripper, which grips each batch carrier individually, and/or by a type of chute in which the walls are arranged in such a way that the individual batch carriers are transferred on a predetermined path due to gravitational force, and/or by way of a line system, for example, in the manner of a pipe mail in which the batch carriers are transferred, in particular, by use of vacuum/compressed air.

Both batch return device 208 [sic], transfer device 203 as well as ejector 207 can be configured as one machine unit arranged between vertical magazines 200 and bristle filament cassettes 204. Alternatively, these devices can also be configured as separate units.

Four bristle filament cassettes 204 in FIG. 3 are oriented substantially along an arc in an obliquely vertical direction so that two types of bristles can be respectively removed for the production of different bristle bundles and two different types of bristle filaments can then also be refilled.

The bristle filament cassettes and the vertical magazines can be provided in any desired number.

The bristle filaments are held in bristle filament cassettes 204 under tension by pusher S in such a way that they are pressed out of bristle bundle removal opening 211 in the direction toward and against an outer peripheral surface of bristle bundle separating device 212.

Such kinematics for separating individual bristle bundles is known, for example, from DE 100 623 98 A1 or from EP 1 522 234 A2. The bristle bundle separating device described in DE 100 623 98 A1 or in EP 1 522 234 A2 is with this reference made to be part of the disclosure content of the present application and constitutes an example of a bristle bundle separating device.

For example, the circular disk of bristle bundle separating device 212, formed on the latter's outer circumference with one or several recesses 218 for receiving bristles for forming a bristle bundle 217, rotates clockwise between a receiving position and a dispensing position.

In the dispensing position, the bristle bundle can therefore be attached directly to a brush head 219 or transferred into an intermediate template in which a plurality of bristle bundles are arranged before they are attached to the brush head.

The attachment of the bristle bundles in the brush head can be effected by way of the so-called anchor technique or the in-mold technique, as known, for example, from EP 1 181 144 B1 and EP 0 759 711 B1.

In the anchor technique, the bristle bundles are placed around a metallic clip and there attached to the bristle carrier. In the in-mold technique, melt-molten plastic material, which forms the bristle bundle carrier, is injected into an incompletely closed cavity in order to fastening the bristle bundle and is cooled so that the bristle head, which is bristled in this manner, is produced.

LIST OF REFERENCE NUMERALS batch carrier 1
batch of bristle filaments 2
openings 3.3'
flange 4
bristle filament 6, 6'
vertical magazine 200
vertical wall of the vertical magazine 201
feed opening 202
transfer device 203
bristle filament cassette 204
filling opening 206
ejector 207
batch carrier return device 208
collection container 209
bristle bundle removal opening 211
bristle bundle separating device 212
bristle bundle 217
recess 218
brush head 219
pusher S
thickness of the batch carrier d
height of the batch of bristle filaments h
diameter of the batch carrier D

The invention claimed is:

1. A feeding device for feeding batches of bristle filaments to a bristle filament cassette, said feeding device comprising a vertical magazine and at least one batch of bristle filaments arranged therein, wherein said batch of bristle filaments is held in a reusable and circumferentially enclosed batch carrier, wherein said batch carrier comprises a frame formed by a ring, the ring having a thickness that substantially corresponds to a length of said filaments contained in said at least one batch of bristle filaments, and wherein said frame comprises an orientation identification device by way of which said frame can be oriented in said vertical magazine in such a way that said filaments of said batch of bristle filaments arranged therein are always positioned in said vertical magazine having a predetermined orientation with respect to said bristle filament cassette.

2. A feeding device according to claim 1, wherein said frame is open on both sides in the horizontal direction and designed in such a way that substantially said entire batch of bristle filaments can be introduced into said frame from one side and can be removed from said frame on the opposite side.

3. A feeding device according to claim 1, wherein said frame has a substantially uniform wall thickness in its circumferential direction.

4. A feeding device according to claim 1, wherein said frame is an injection-molded member.

5. A feeding device according to claim 1, wherein said orientation identification device is formed by a flange surrounding at least one horizontal opening of said frame on an outside thereof.

6. A feeding device according to claim 1, wherein an inner wall of said frame holds said batch of bristle filaments under pre-tension.

7. A tufting device for brushes comprising:

a feeding device for feeding batches of bristle filaments to a bristle filament cassette, said feeding device comprising a vertical magazine and at least one batch of bristle filaments arranged therein, the vertical magazine being configured to hold the at least one batch of bristle filaments in a horizontal filament axis orientation and to feed said at least one batch of bristle filaments in a vertical direction, wherein said batch of bristle filaments is held in a reusable and circumferentially enclosed batch carrier;

a bristle filament cassette to which said batch of bristle filaments pre-assembled in said tufting device can be fed with a transfer device;

a bristle bundle separating device, by use of which at least one bristle bundle can be separated from said bristle filaments contained in said bristle filament cassette;

wherein said tufting device is configured to insert said bristle bundle, which is separated by said bristle bundle separating device, into a brush head, and wherein said transfer device is configured to feed said batch of bristle filaments to said bristle filament cassette while maintaining the horizontal bristle filament axis orientation of said batch.

8. A tufting device according to claim 7, wherein the device is a device for tufting tooth brushes.

9. A tufting device according to claim 8, wherein an ejector is associated with said transfer device and ejects said batch of bristle filaments out of said batch carrier by use of compressed air and feeds it to said bristle filament cassette.

10. A tufting device according to claim 9, wherein a batch carrier return device is associated with said transfer device and transfers said batch carrier having the batch of bristle filaments ejected therefrom to a collecting point.

11. A tufting device according to claim 8, wherein said tufting device is configured such that said separated bristle bundle is fed to said brush head while maintaining the bristle filament axis orientation.

12. A feeding device for feeding batches of bristle filaments to a bristle filament cassette, said feeding device comprising a vertical magazine and at least one batch of bristle filaments arranged therein, wherein said batch of bristle filaments is held in a reusable and circumferentially enclosed batch carrier, wherein the batch carrier comprises a frame, said frame comprising an orientation identification device by way of which said frame can be oriented in said vertical magazine in such a way that said filaments of said batch of bristle filaments arranged therein are always positioned in said vertical magazine having a predetermined orientation with respect to said bristle filament cassette, and wherein said orientation identification device is formed by a flange surrounding at least one horizontal opening of said frame on an outside thereof.

13. A feeding device according to claim 12, wherein an inner wall of said frame holds said batch of bristle filaments under pre-tension.

14. A feeding device according to claim 13, wherein said batch carrier is formed by said frame which is open on both sides in the horizontal direction and designed in such a way that substantially said entire batch of bristle filaments can be introduced into said frame from one side and can be removed from said frame on the opposite side.

15. A feeding device according to claim 14, wherein said frame is formed by a ring.

16. A feeding device according to claim 15, wherein said frame has a thickness that substantially corresponds to a length of said filaments contained in said batch of bristle filaments.

17. A feeding device according to claim 16, wherein said frame has a substantially uniform wall thickness in its circumferential direction.

* * * * *